US008661971B2

(12) United States Patent
Lee

(10) Patent No.: US 8,661,971 B2
(45) Date of Patent: Mar. 4, 2014

(54) METHOD OF MANUFACTURING COMPRESSED LUMP OF METAL SCRAP

(75) Inventor: Tae Ho Lee, Busan (KR)

(73) Assignee: Daejong Industry Co., Ltd., Gyeonggi-do (KR)

( * ) Notice: Subject to any disclaimer, the term of this patent is extended or adjusted under 35 U.S.C. 154(b) by 0 days.

(21) Appl. No.: 13/512,473

(22) PCT Filed: Oct. 25, 2011

(86) PCT No.: PCT/KR2011/007989

§ 371 (c)(1),
(2), (4) Date: May 29, 2012

(87) PCT Pub. No.: WO2012/099320

PCT Pub. Date: Jul. 26, 2012

(65) Prior Publication Data

US 2013/0112093 A1 May 9, 2013

(30) Foreign Application Priority Data

Jan. 17, 2011 (KR) ..... 10-2011-0004709

(51) Int. Cl.
*B30B 9/32* (2006.01)

(52) U.S. Cl.
CPC ..... *B30B 9/327* (2013.01); *Y10S 100/906* (2013.01)
USPC ..... 100/35; 100/96 R; 100/906

(58) Field of Classification Search
USPC ..... 100/35, 42, 94, 95, 98 R, 906; 75/770; 72/362, 370.27, 333; 29/403.2
See application file for complete search history.

(56) References Cited

U.S. PATENT DOCUMENTS 3,674,444 A * 7/1972 Akemasa Otani ..... 428/576
3,782,274 A * 1/1974 Thompson ..... 100/95
4,435,973 A * 3/1984 Nakazawa et al. ..... 72/327
4,557,190 A * 12/1985 Vezzani ..... 100/98 R

* cited by examiner

*Primary Examiner* — Jimmy T Nguyen
(74) *Attorney, Agent, or Firm* — Kramer & Amado P.C.

(57) ABSTRACT

A method of manufacturing a compressed lump of metal scrap involves forming a through hole in the metal scrap instead of drilling a finished compressed lump of metal scrap to form the through hole in the compressed lump of metal scrap. Friction and stress applied to the core are minimized while the through hole is formed in the compressed lump of metal scrap, which is compressed with high density, thereby minimizing damage to the core and thus minimizing a trouble occurrence rate.

2 Claims, 14 Drawing Sheets

METHOD OF MANUFACTURING COMPRESSED LUMP OF METAL SCRAP

This is a national stage application of PCT/KR11/07989, filed Jul. 25, 2011 which in turn claims the benefit of KR 10-2011-0004709, filed on Jan. 17, 2011. The entire disclosure of the prior applications is hereby incorporated by reference herein in its entirety.

BACKGROUND OF THE INVENTION

1. Field of the Invention

The present invention relates to a method of manufacturing a compressed lump of metal scrap that is capable of compressing various kinds of collected metal scrap into a standardized form so that the metal scrap can be directly charged into a blast furnace.

2. Description of the Related Art

As is generally known, various kinds of metal scrap, including materials dug from various production fields or used molds disposed from various production fields, reinforcing rods obtained from demolished buildings, and metal waste, such as scrapped vehicles, disused gas containers or cans obtained from various consumption fields, are collected, sorted, and melted to manufacture various kinds of steel materials, thereby reducing resources and energy used to manufacture steel materials and eventually protecting environment, To this end, metal scrap is basically sorted according to kinds of the metal scrap and is compressed into a compressed lump of metal scrap which is formed and standardized so that the compressed lump of metal scrap can be directly charged into a blast furnace of a steel mill, to which the compressed lump of metal scrap is supplied.

Such a compressed lump of metal scrap is generally configured so that the sum of the width, length, and height of the compressed lump of metal scrap is between 600 mm and 2100 mm. Also, metal scrap is compressed so that a compressed lump of metal scrap has the maximum length of less than 800 mm and a density of 0.15 or more.

In a conventional apparatus for manufacturing such a compressed lump of metal scrap, metal scrap, including ferrous metal scrap and nonferrous metal scrap, such as aluminum and copper, collected via various routes is sorted and compressed by a compress apparatus to form a compressed lump of metal scrap in the shape of a hexahedral body having a predetermined standard. A representative example of the apparatus for manufacturing the compressed lump of metal scrap is disclosed in Japanese Utility Model Publication No. S38-11798 entitled "Scrap press apparatus" (hereinafter, referred to as a 'cited invention').

The cited invention provides a scrap press apparatus configured to have a structure in which a slide type upper cover 1 is installed above a scrap molding chamber 2 having a press plate 5 and transverse press plates 20 provided at left and right sides thereof, a stationary cover unit 3 is installed above a material molding side of the scrap molding chamber 2, a lower cover 7, which can be freely opened and closed, to discharge a shaped product is installed under the material molding side of the scrap molding chamber 2, a shearing cutter 4 is installed at a contact portion between the stationary cover unit 3 and the slide type cover, and a shearing cutter 4 is installed above the press plate 5.

In the cited invention, metal scrap is charged into the scrap molding chamber 2, the upper cover 1 is closed, and a primary cylinder 14 is driven to advance a piston 13. As a result, the press plate 5 primarily compresses metal scrap in the scrap molding chamber 2 into a form as indicated by a dotted line of FIG. 2. Subsequently, the opposite transverse press plates 20 are advanced to the middle of the scrap molding chamber 2 by pistons 22 of cylinders 21 to secondarily compress the primarily compressed metal scrap. After the metal scrap is secondarily compressed, a lower cover actuating cylinder 8 connected to the lower side of the lower cover 7 is driven to pull the middle of a link 10. As a result, the lower cover 7 is opened to the lower side, and therefore, a compressed lump 23 of metal scrap falls and is carried outside by a conveyor 18.

A required number of compressed lumps of metal scrap of a predetermined standard manufactured according to the cited invention with the above-stated construction are directly charged into a blast furnace to manufacture various kinds of steel products. Consequently, a very efficient operation is possible.

On the other hand, such a compressed lump of metal scrap is obtained by compressing a large amount of metal scrap with high density so that the volume of the compressed lump of metal scrap is small. For this reason, the compressed lump of metal scrap has large thermal capacity, and therefore, it is necessary to heat the compressed lump of metal scrap for a long time using a large amount of energy so as to melt the compressed lump of metal scrap. Consequently, a large amount of energy is consumed in a melting process with the result that costs necessary to manufacture steel products are greatly increased. Also, a discharge amount of carbon is increased since large amount of energy is consumed with the result that environment is polluted.

As a rule, metal scrap must be sorted according to ingredients of the metal scrap so that pure nonferrous metal scrap or pure ferrous metal scrap can be separately compressed to manufacture such a compressed lump of metal scrap. However, some thoughtless processors mix concrete, which is heavy, with metal scrap to manufacture a poor compressed lump of metal scrap. If such a poor compressed lump of metal scrap is charged into a blast furnace, the blast furnace is contaminated by impurities. Enormous expense is needed to remove contaminants from the blast furnace, and, in addition, a production project is frustrated. As a result, steelmakers have difficulty in using a compressed lump of metal scrap.

SUMMARY OF THE INVENTION

Therefore, the present invention has been made in view of the above problems, and it is an object of the present invention to provide a method of forming a through hole in a compressed lump of metal scrap during manufacture of the compressed lump of metal scrap so that the compressed lump of metal scrap can be efficiently melted and the interior of the compressed lump of metal scrap can be observed instead of drilling a finished compressed lump of metal scrap to foil a through hole in the compressed lump of metal scrap as in the cited invention, thereby efficiently producing the compressed lump of metal scrap.

In accordance with the present invention, the above and other objects can be accomplished by the provision of a method of manufacturing a compressed lump of metal scrap using an apparatus for manufacturing a compressed lump of metal scrap including a primary compression cylinder installed at one side of a compression chamber, a primary press plate configured to be moved in a primary compression space by a piston of the primary compression cylinder, a secondary compression cylinder installed at the other side of the compression chamber, a primary press plate configured to be moved in a secondary compression space by a piston of the secondary compression cylinder, a discharge plate disposed at the middle of the secondary compression space, and an opening and closing unit to open and close the discharge plate, wherein one or more cores are installed so as to stand at the middle of the secondary compression space so that the cores are installed at right angles to the primary press plate and in parallel to the secondary press plates, and the cores are configured to be advanced and retreated by additionally installed core cylinders, the method of manufacturing the compressed lump of metal scrap including a step of charging metal scrap into the compression chamber, a step of closing a cover using a cover cylinder and performing a locking operation, a primary compression step of primarily compressing the metal scrap charged in the compression chamber using the primary compression cylinder, a secondary compression step of secondarily compressing the primarily compressed metal scrap using the secondary compression cylinder, a discharge step of discharging a compressed lump of metal scrap, compressed with target density through the secondary compression, through a discharge port, wherein the method of manufacturing the compressed lump of metal scrap further includes a space occupation step of installing a core in the middle of the secondary compression space to occupy a region of the secondary compression space where a through hole is to be formed before the primary compression step is carded out, a through hole forming step of maintaining the region of the secondary compression space occupied by the core to form a through hole in a compressed Jump of metal scrap while performing secondary compression using a secondary compression cylinder after the primary compression is completed, and a core retreating step of retreating the core to discharge the compressed lump of metal scrap, compressed with target density, after the through hole is formed in the compressed lump of metal scrap.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

In one embodiment of the present invention, a method of manufacturing a compressed lump of metal scrap includes a step of charging metal scrap into a compression chamber, a step of closing a cover using a cover cylinder and performing a locking operation, a primary compression step of primarily compressing the metal scrap charged in the compression chamber using a primary compression cylinder, a secondary compression step of secondarily compressing the primarily compressed metal scrap using a secondary compression cylinder, a discharge step of discharging a compressed lump of metal scrap, compressed with target density through the secondary compression, through the discharge port, wherein the method of manufacturing the compressed lump of metal scrap further includes a space occupation step of installing a core in the middle of a secondary compression space to occupy a region of the secondary compression space where a through hole is to be formed before the primary compression step is carried out, a through hole forming step of maintaining the region of the secondary compression space occupied by the core to form a through hole in a compressed lump of metal scrap while performing secondary compression using a secondary compression cylinder after the primary compression is completed, and a core retreating step of retreating the core to discharge the compressed lump of metal scrap, compressed with target density, after the through hole is formed in the compressed lump of metal scrap.

Now, preferred embodiments of the present invention will be described in detail with reference to the accompanying drawings so that the present invention can be easily made by a person having ordinary skill in the art to which the present invention pertains.

Figure 1:
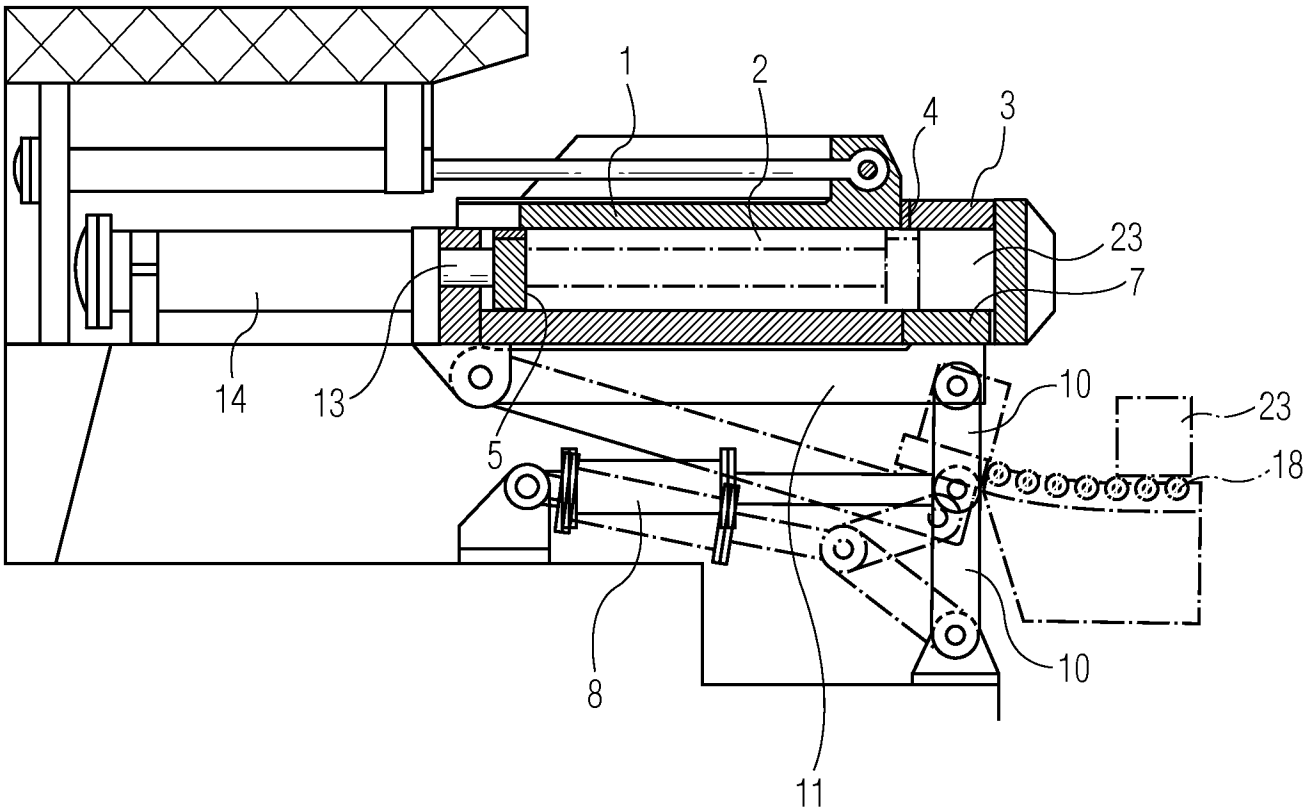
FIG. 1 is a longitudinal sectional view showing the construction of a cited invention.
Figure 2:
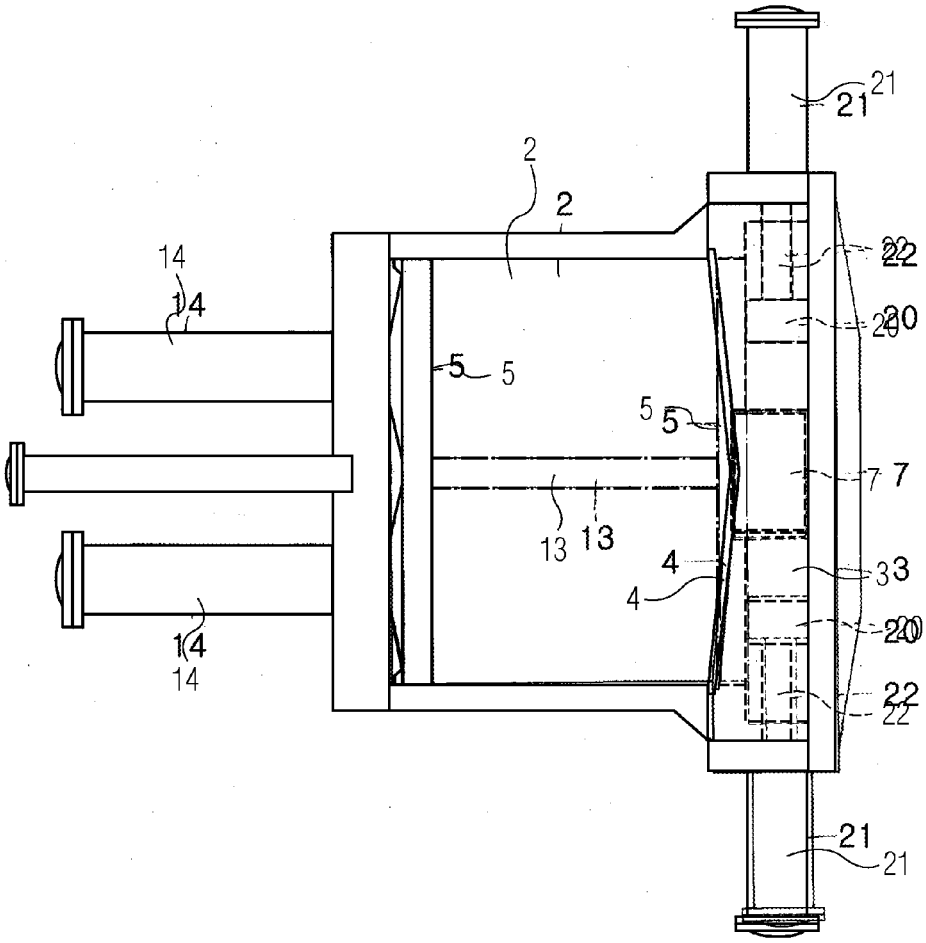
FIG. 2 is a plan view illustrating the construction of the cited invention.
Figure 3:
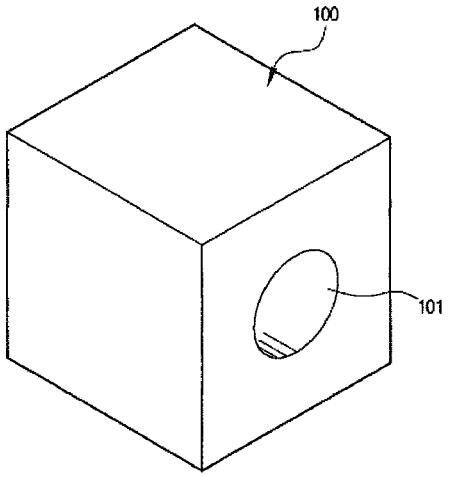
FIG. 3 is a perspective view showing a compressed lump of metal scrap according to the present invention.

First, a compressed lump 100 of metal scrap according to the present invention is shown in FIG. 3.

As shown in FIG. 3, the compressed lump 100 of metal scrap is formed into a hexahedral body having a predetermined width, length and height according to the present invention. A straight through hole 101 is formed in the compressed lump 100 of metal scrap so that the through hole 101 extends through the compressed lump 100 of metal scrap. When the compressed lump 100 of metal scrap is introduced into a blast furnace, therefore, hot air and molten metal can infiltrate into the compressed lump 100 of metal scrap through the through hole 101. Consequently, it is possible to melt the compressed lump 100 of metal scrap using a small amount of fuel.

Also, it is possible for an engineer to inspect the interior of the compressed lump 100 of metal scrap through the through hole 101 with the naked eye or using a camera before the compressed lump 100 of metal scrap is introduced into the blast furnace.

Figure 4A:
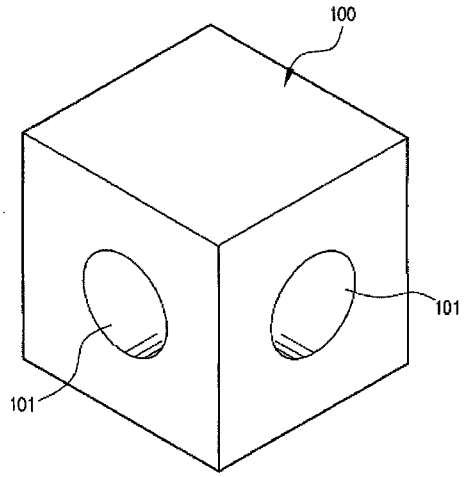
FIGS. 4A, 4B and 5 are perspective views showing other embodiments of the compressed lump of metal scrap according to the present invention.
Figure 4B:
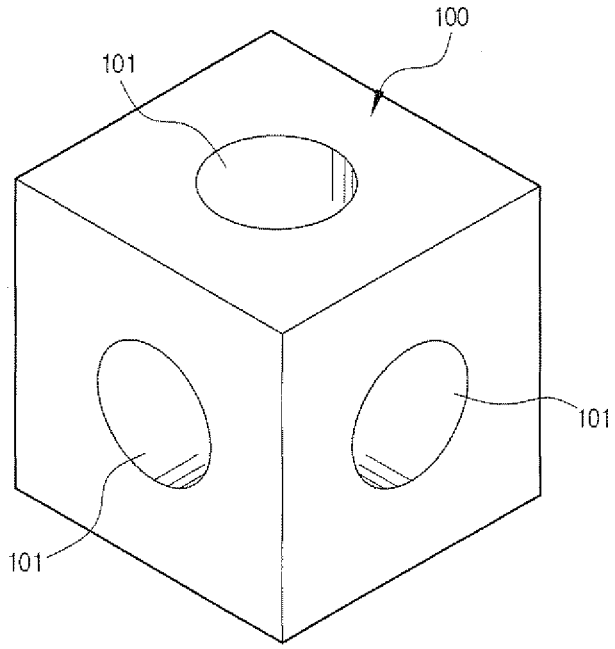
Figure 5:
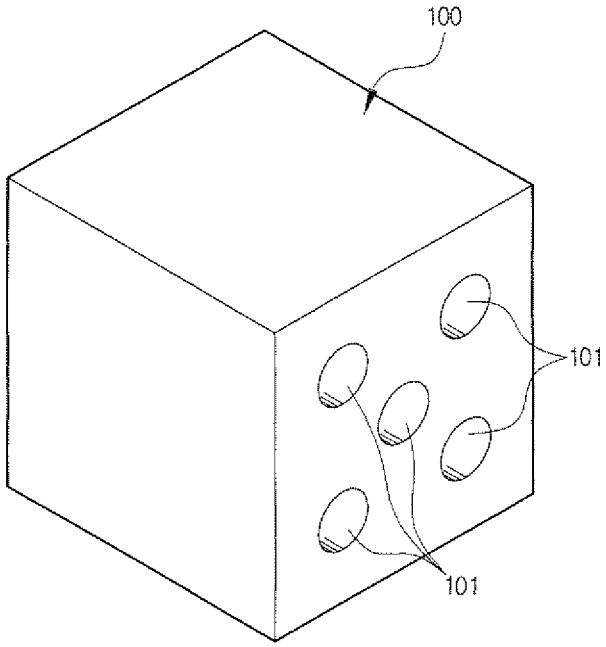

According to circumstances, two or more through holes 101, which intersect each other at right angles, may be formed in the compressed lump 100 of metal scrap as shown in FIGS. 4A and 413. In addition, a plurality of through holes 101, which extend through only two sides of the compressed lump 100 of metal scrap, may be formed in the compressed lump 100 of metal scrap as shown in FIG. 5.

The more through holes 101 the compressed lump 100 of metal scrap has, the easier the compressed lump 100 of metal scrap melts. However, it is necessary to install a plurality of cores 201 and a plurality of core cylinders 200, which are operated in a state in which metal scrap is compressed under high pressure. For this reason, it may be most economical to form only one through hole 101 in consideration of manufacturing equipment costs. Hereinafter, therefore, the present invention will be described based on embodiments of the present invention that form one through hole 101.

Figure 6:
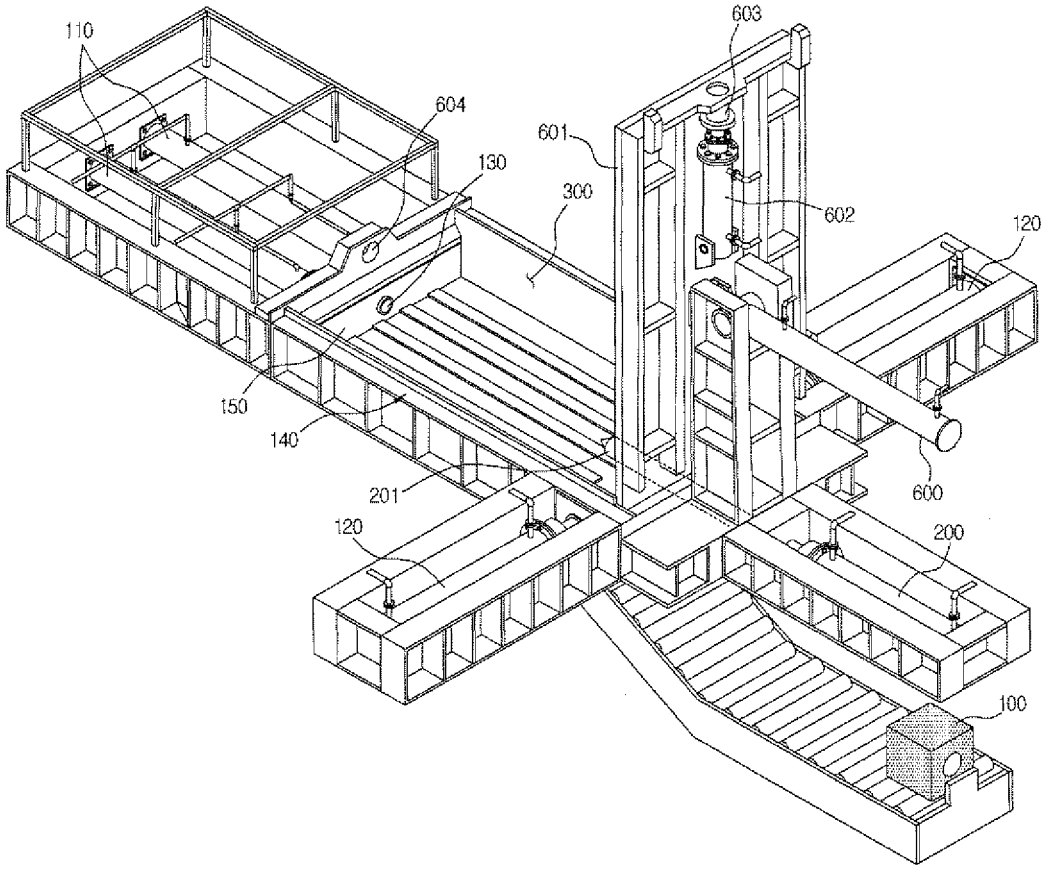
FIG. 6 is a perspective view showing the overall construction of an apparatus for manufacturing a compressed lump of metal scrap according to the present invention.

FIG. 6 is a perspective view showing the concrete structure of a manufacturing apparatus according to the present invention. As shown in FIG. 6, the manufacturing apparatus according to the present invention includes two primary compression cylinders 110, which are long. The primary compression cylinders 110 are provided to obtain force sufficient to primarily compress various forms of metal scrap, charged in a compression chamber 140, during movement of the primary compression cylinders 110 in a primary compression space of the compression chamber from one side of the compression chamber 140. One or three primary compression cylinders may be installed based on kinds and charge amount of metal scrap.

Also, secondary compression cylinders 120 are installed at opposite sides of a secondary compression space 400 of the compression chamber 140. A secondary press plate 160 is fixed to a piston of each of the secondary compression cylinders 120 so that the secondary press plate 160 can be advanced toward the middle of the secondary compression space 400.

Also, the movement distance of the secondary press plate 160 installed at each side of the compression chamber 140 is the distance by which the secondary press plate 160 moves to the compressed lump 100 of metal scrap melts formed at the middle of the secondary compression space 400. Consequently, the stroke of the secondary press plate 160 is short, and therefore, the lengths of each secondary compression cylinder 120 and the piston thereof are relatively short.

Particularly, in the present invention, a core 201 configured to penetrate the middle of the compressed lump 100 of metal scrap and a core cylinder 200 to reciprocate the core 201 are installed in addition to the construction of the cited invention. The core 201 is installed at right angles to a primary press plate 150 and in parallel to the secondary press plates 160. Also, the core 201 is installed so as to stand at the middle of the secondary compression space.

The core 201 according to the present invention is advanced and retreated by the additionally installed core cylinder 200. A tip 170 having incline planes is formed at the front end of the core 201. The tip 170 is received in a core tip receiving groove 130 formed at a contact region of the primary press plate 150 at a position where primary compression is completed. Consequently, it is possible to carry out secondary compression in a very stable state.

Also, the manufacturing apparatus according to the present invention further includes a discharge plate 502 installed at the middle of the secondary compression space 400 and an opening and closing unit 500 to open and close the discharge plate 502.

The opening and closing unit 500 may include a hydraulic cylinder 504 and a piston in addition to the discharge plate 502. The opening and closing unit 500 may be configured so that the discharge plate 502, which is formed of a plate-shaped member having a thickness sufficient to bear pressure, is reciprocated in a guide groove 503 to open and close a discharge port 501. Alternatively, the discharge plate 502 may be opened and closed by the hydraulic cylinder 504 so as to open and close the discharge port 501.

Figure 7A:
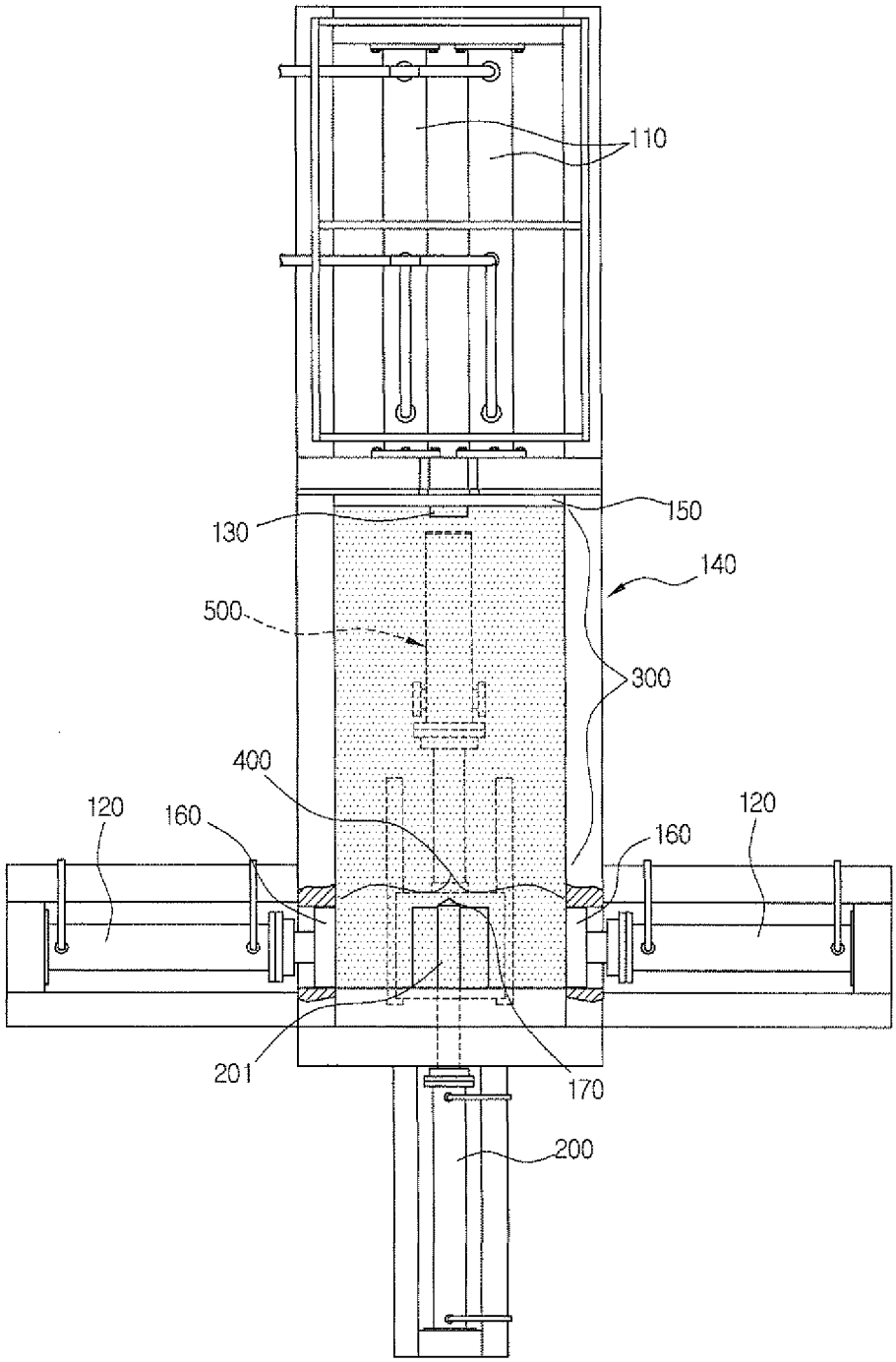
FIG. 7A is a plan view showing an operation standby state in a compression chamber of the apparatus for manufacturing the compressed lump of metal scrap according to the present invention.

In the present invention, the primary and secondary compression cylinders 110 and 120, the core cylinder 200, the hydraulic cylinder 504, a cover cylinder 600 and a locking cylinder 602 are used. Although not shown, a hydraulic pipe is connected to the pistons so that the pistons can be advanced or retreated according to directions in which hydraulic pressure is supplied, which is well known in the art to which the present invention pertains, and therefore, a description thereof will be omitted for the sake of convenience. An operation standby state of the manufacturing apparatus according to the present invention is shown in a plan view of FIG. 7A. As shown in FIG. 7A, the core 201 is advanced by the core cylinder 200, the primary and secondary press plates 150 and 160 are located at the same position as walls of the compression chamber 140 in a state in which the primary and secondary compress cylinders and the opening and closing cylinder are in an operation standby mode, and the opening and closing cylinder is placed in a state in which the discharge port 510 is closed by the discharge plate 502.

Figure 7B:
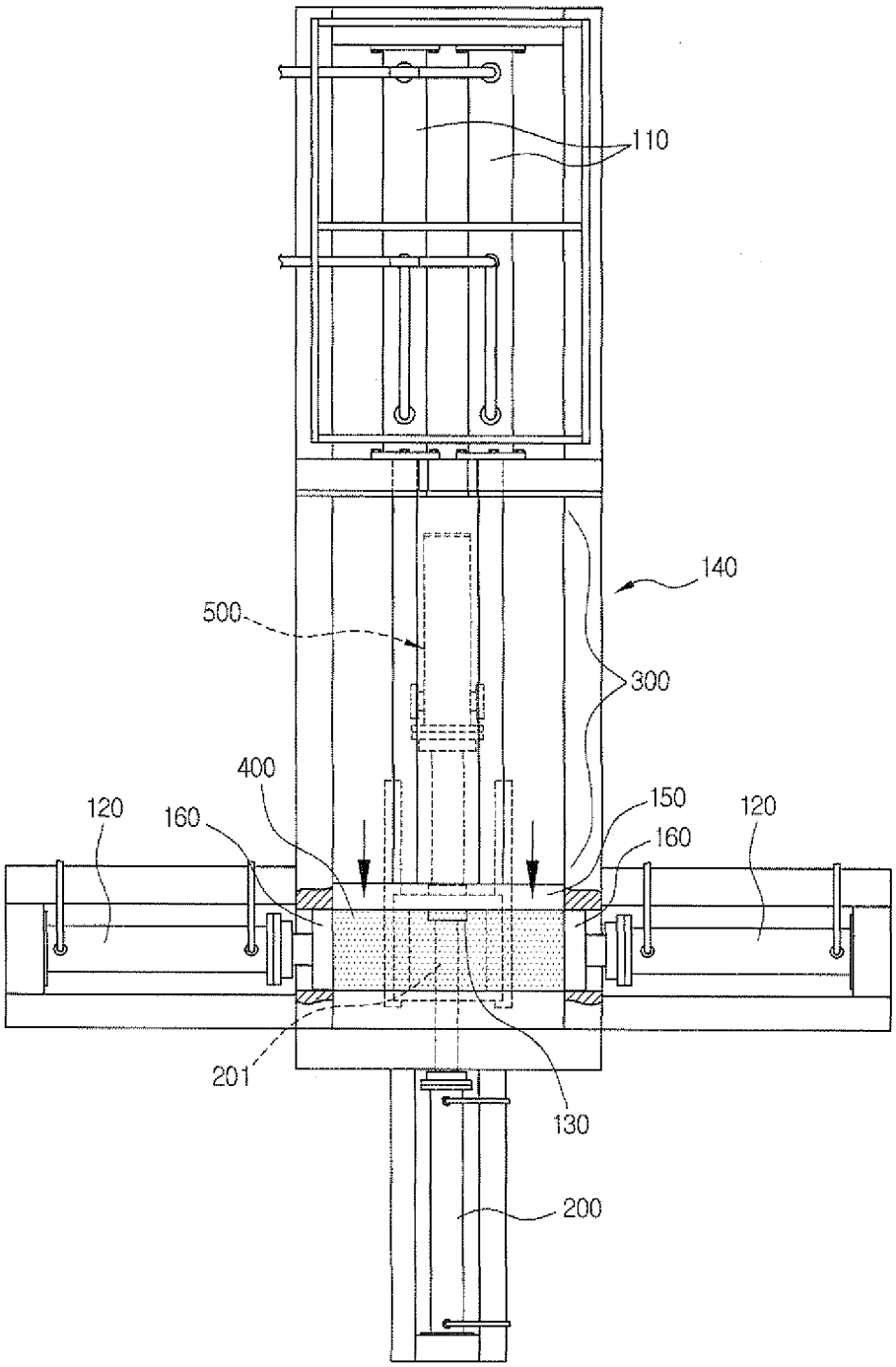
FIG. 7B is a plan view showing a state in which a primary compression cylinder is driven in the compression chamber, in which metal scrap has been charged, to advance a primary press plate with the result that primary compression is completed in the apparatus for manufacturing the compressed lump of metal scrap according to the present invention.

In the manufacturing apparatus with the above-stated construction according to the present invention, first, the primary press plate 150 is moved to the end of the primary compression space 300 by the pistons of the primary compression cylinders 110. Consequently, metal scrap, which has been primarily compressed in the compression chamber 140, is placed in the secondary compression space 400 in a standby state, which is shown in FIG. 7B. In this state, the tip 170 of the core is received in the core tip receiving groove 130 formed at the middle of the primary press plate 150 according to the present invention.

Consequently, the metal scrap in the compression chamber 140 is clustered into the secondary compression space 400 while the density of the metal scrap is primarily increased by the primary press plate 150, and the metal scrap clustered into the secondary compression space 400 is primarily compressed. At the same time, the through hole 101 is formed in the clustered metal scrap by the core 201.

Figure 7C:
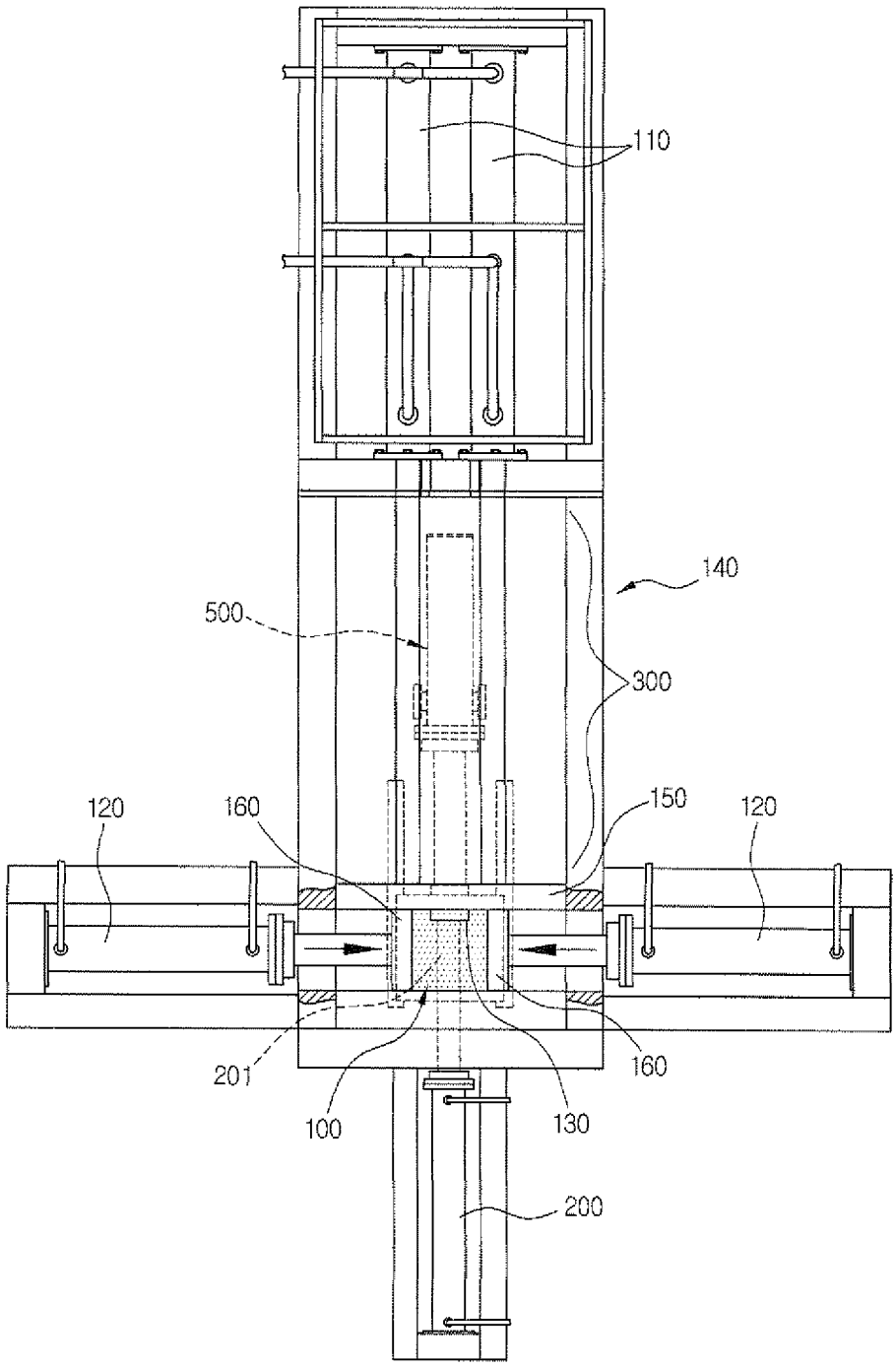
FIG. 7C is a plan view showing a state in which, after the primary press plate is advanced, a secondary press plate is advanced to a secondary compression space by a secondary compression cylinder in the apparatus for manufacturing the compressed lump of metal scrap according to the present invention.
Figure 7D:
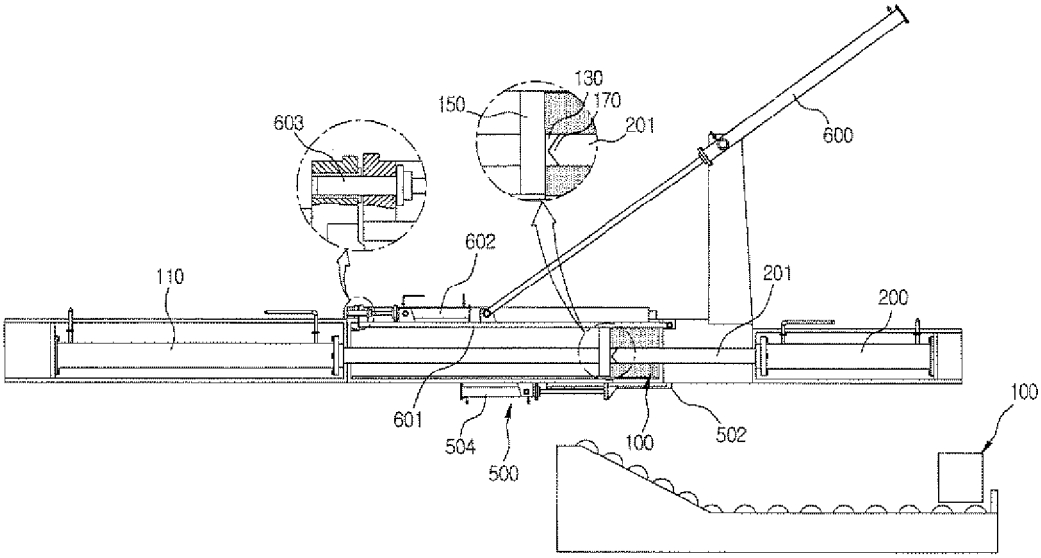
FIG. 7D is a longitudinal sectional view showing a state shown in FIG. 7C.

When the secondary press plate 160 starts to compress the metal scrap in the secondary compression space 400 according to operation of the secondary compression cylinder 120 in a state in which the core 201 of the cylinder protrudes, the metal scrap starts to be compressed at density higher than that of the primary compression as shown in FIG. 7C. When the secondary press plate 160 is advanced to a position corresponding to the final dimensions of a compressed lump 100 of metal scrap, the advancement of the secondary press plate 160 is stopped by the secondary compression cylinder 120. In this state, the through hole 101 is formed in the compressed lump 100 of metal scrap by the core 201 as shown in FIG. 7D.

Figure 7E:
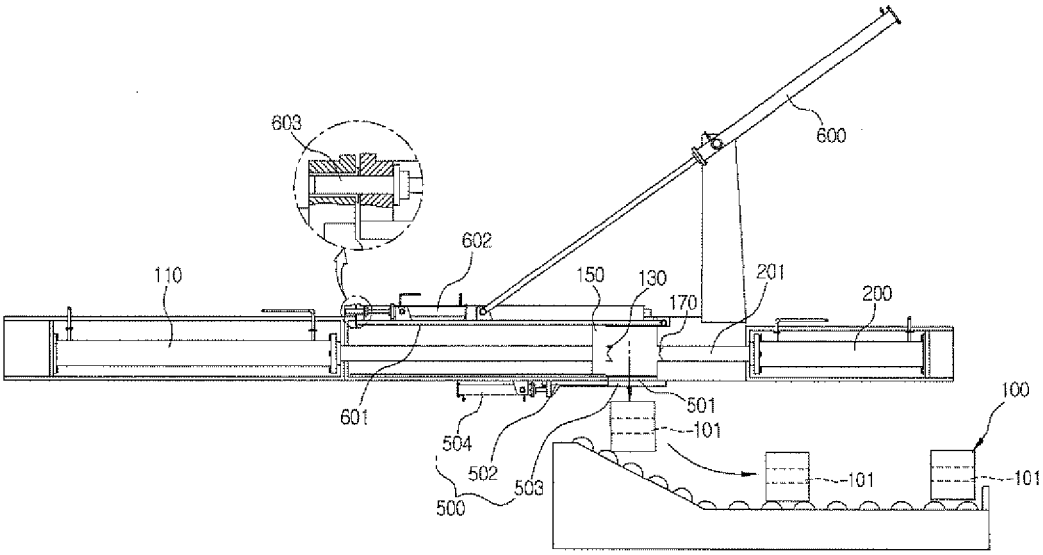
FIG. 7E is a longitudinal sectional view showing a state in which, after the primary and secondary press plates are advanced, a core is retreated by a core cylinder, and then a compressed lump of metal scrap is discharged through a discharge port by a discharge plate and an opening and closing cylinder to open and close the discharge plate in the apparatus for manufacturing the compressed lump of metal scrap according to the present invention.

In this state, however, the compressed lump 100 of metal scrap cannot be discharged. According to the present invention, therefore, it is necessary to retreat the core 201 as shown in FIG. 7E.

To this end, the core cylinder 200 is driven. As a result, the core 201 is retreated, and then the primary compression cylinders 110 and the secondary compression cylinders 120 are retreated to their original positions. In addition, the hydraulic cylinder of the opening and closing unit 500 is driven to move the discharge plate 502 with the result that the compressed lump 100 of metal scrap falls through the discharge port 501 and is carried outside by a conveyor.

Subsequently, the hydraulic cylinder of the opening and closing unit 500 is driven to move the discharge plate 502 so that the discharge plate 502 closes the discharge port 501. The core 210 is moved by the core cylinder 200 so that the core 210 returns to a state as shown in FIG. 7A. In this state, a piston 603 of the locking cylinder 602 is separated from a locking hole 604, and then the cover cylinder 600 is driven to lift a cover 601 so that the manufacturing apparatus is in state as shown in FIG. 6. Subsequently, metal scrap is charged into the compression chamber, the primary compression cylinder 110 is driven to resume primary compression with the respect to the metal scrap through the primary press plate 150. In this way, the process of manufacturing the compressed lump 100 of metal scrap is continuously repeated.

Figure 8:
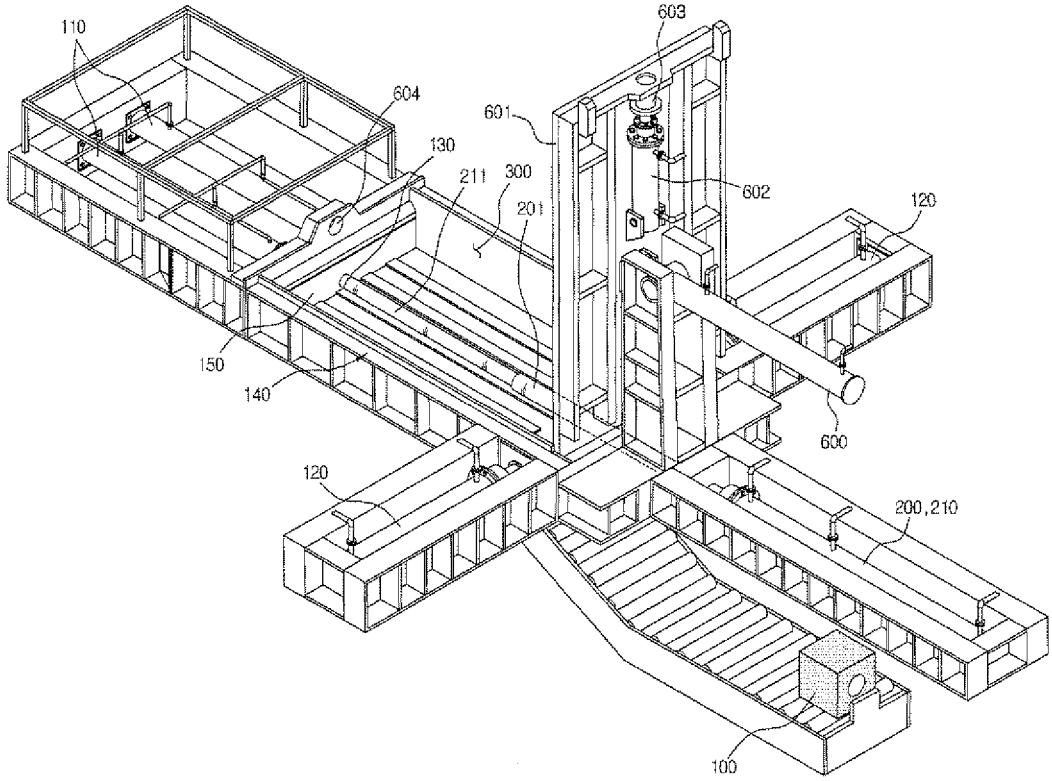
FIG. 8 is a perspective view showing the construction of another embodiment of the apparatus for manufacturing the compressed lump of metal scrap according to the present invention.

In addition, according to the present invention, as shown in FIG. 8, an extension core cylinder 210 is installed on the same axis as the core cylinder 200, a tip 170 is formed at the front end of an extension core 211 configured to be advanced and retreated by the extension core cylinder 210. In an operation standby mode, the tip 170 is received in the core tip receiving groove 130 of the primary press plate 150, and, when metal scrap is charged into the compression chamber 140 in this state, the metal scrap is prevented from being caught between the core tip receiving groove 130 and the tip 170 of the core during primary compression, which may occur in the embodiment shown in FIGS. 6 and 7A to 7E, thereby the occurrence of a state in which smooth operation of the manufacturing apparatus is obstructed is prevented. That is, in this embodiment, the core 210 and the extension core 211 are advanced by the core cylinder 200 and the extension core cylinder 210, respectively, in an operation standby state as shown in a plan view of FIG. 9A, the primary and secondary press plates 150 and 160 are located at the same position as the walls of the compression chamber 140 in a state in which the primary and secondary compress cylinders and the opening and closing cylinder are in an operation standby mode, and the opening and closing cylinder is placed in a state in which the discharge port 510 is closed by the discharge plate 502.

Figure 9A:
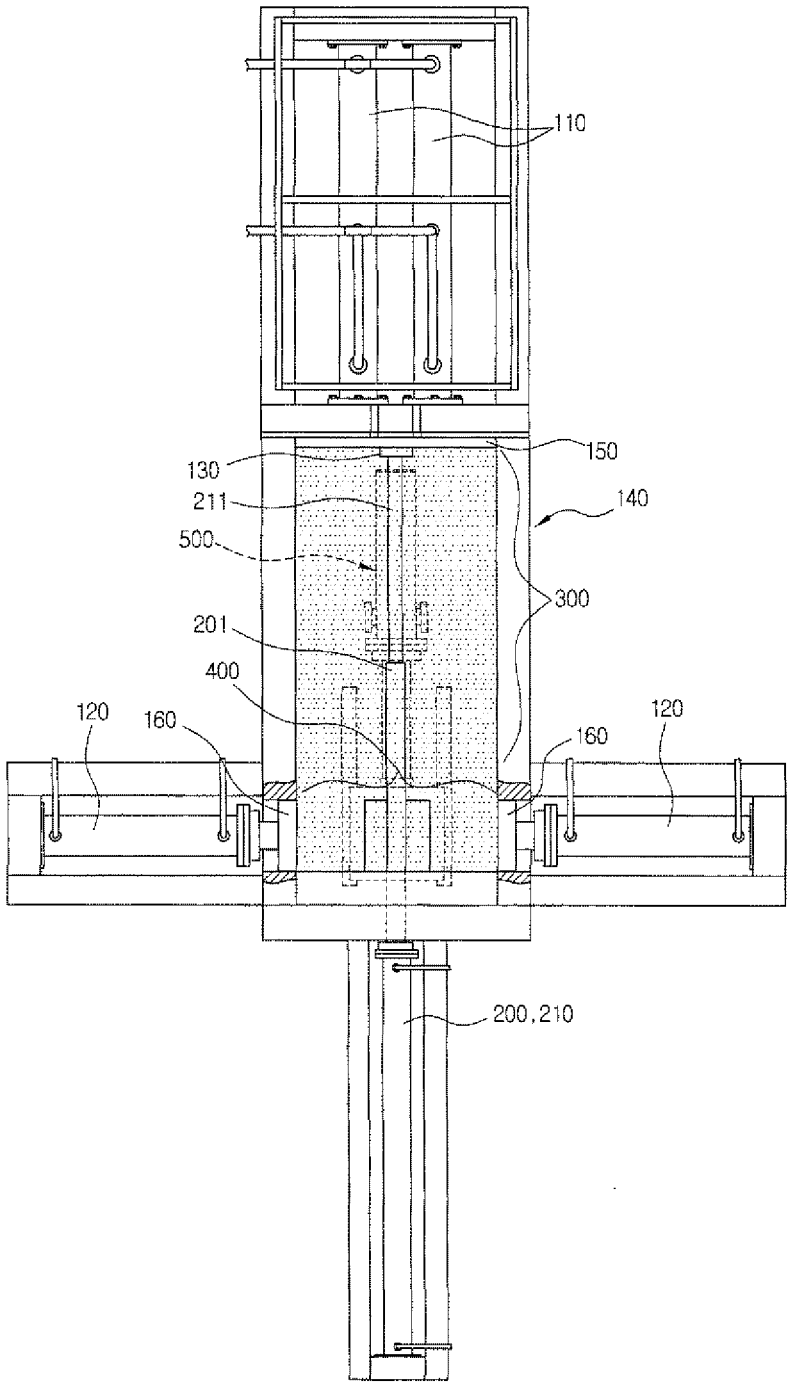
FIG. 9A is a plan view showing an operation standby state in a compression chamber of the apparatus for manufacturing the compressed lump of metal scrap according to the present invention.
Figure 9B:
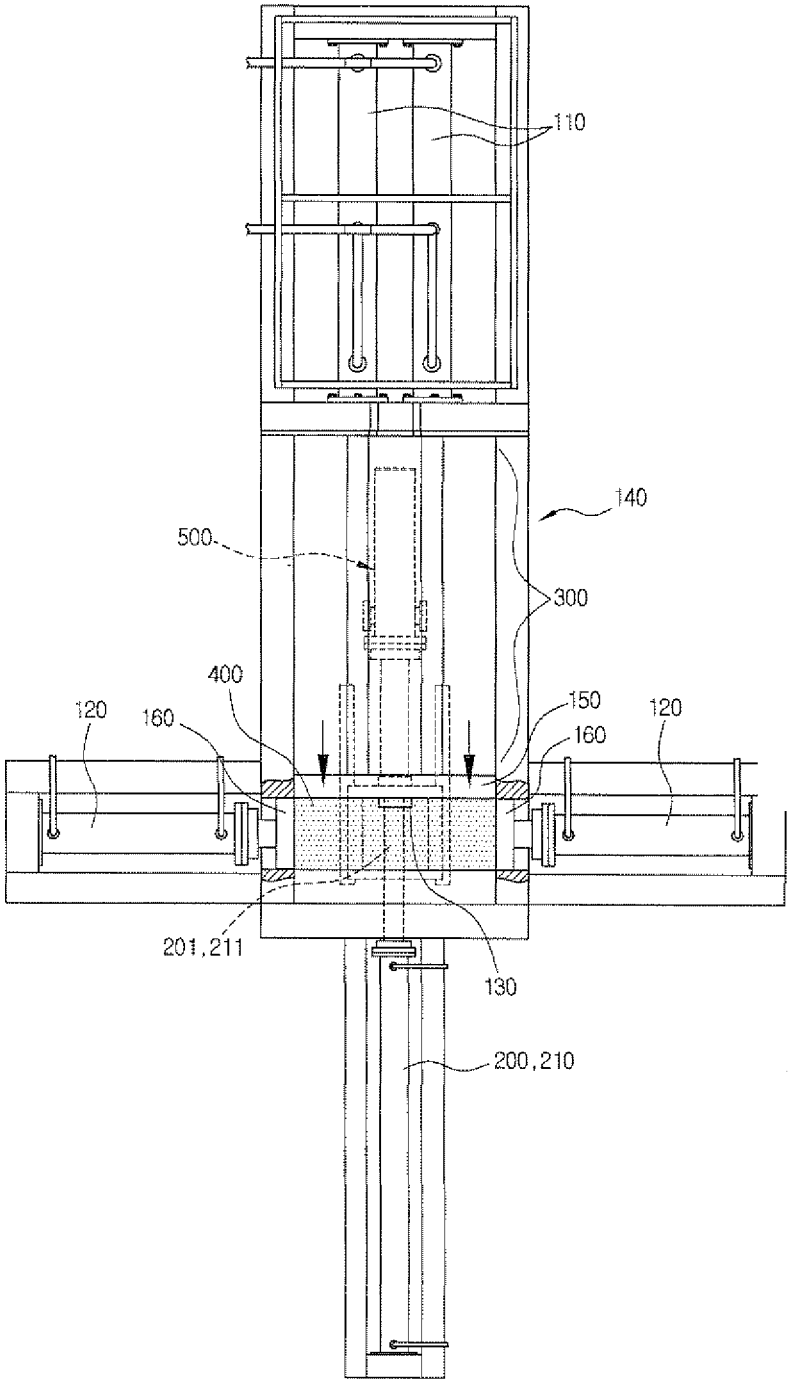
FIG. 9B is a plan view showing a state in which a primary compression cylinder is driven in the compression chamber, in which metal scrap has been charged, to advance a primary press plate with the result that primary compression is completed in the apparatus for manufacturing the compressed lump of metal scrap according to the present invention.

In the manufacturing apparatus with the above-stated construction according to this embodiment of the present invention, first, the primary press plate 150 starts to be moved to the primary compression space 300 by the pistons of the primary compression cylinders 110, and, according to this movement, the extension core cylinder 210 is driven to retreat the extension core 211 and the primary press plate 150 in an interlocked state. The primary press plate 150 and the extension core 211 are moved to a position of the compression chamber 140 where primary compression is completed. Consequently, metal scrap is placed in the secondary compression space 400 in a standby state, which is shown in FIG. 9B.

In this state, the tip 170 of the extension core 211 is received in the core tip receiving groove 130 formed at the middle of the primary press plate 150 according to the present invention. Consequently, a through hole 101 starts to be formed in the metal scrap simultaneously upon starting primary compression. The metal scrap is prevent from moving to the primary press plate 150, the extension core 211 and the core 201 during this process, thereby completely preventing compression from being obstructed. Also, excessive friction between the extension core 211 and the core 201 and the metal scrap is prevented, and stress is prevented from being applied to the extension core 211 and the core 201, thereby achieving stable operation of the manufacturing apparatus.

Figure 9C:
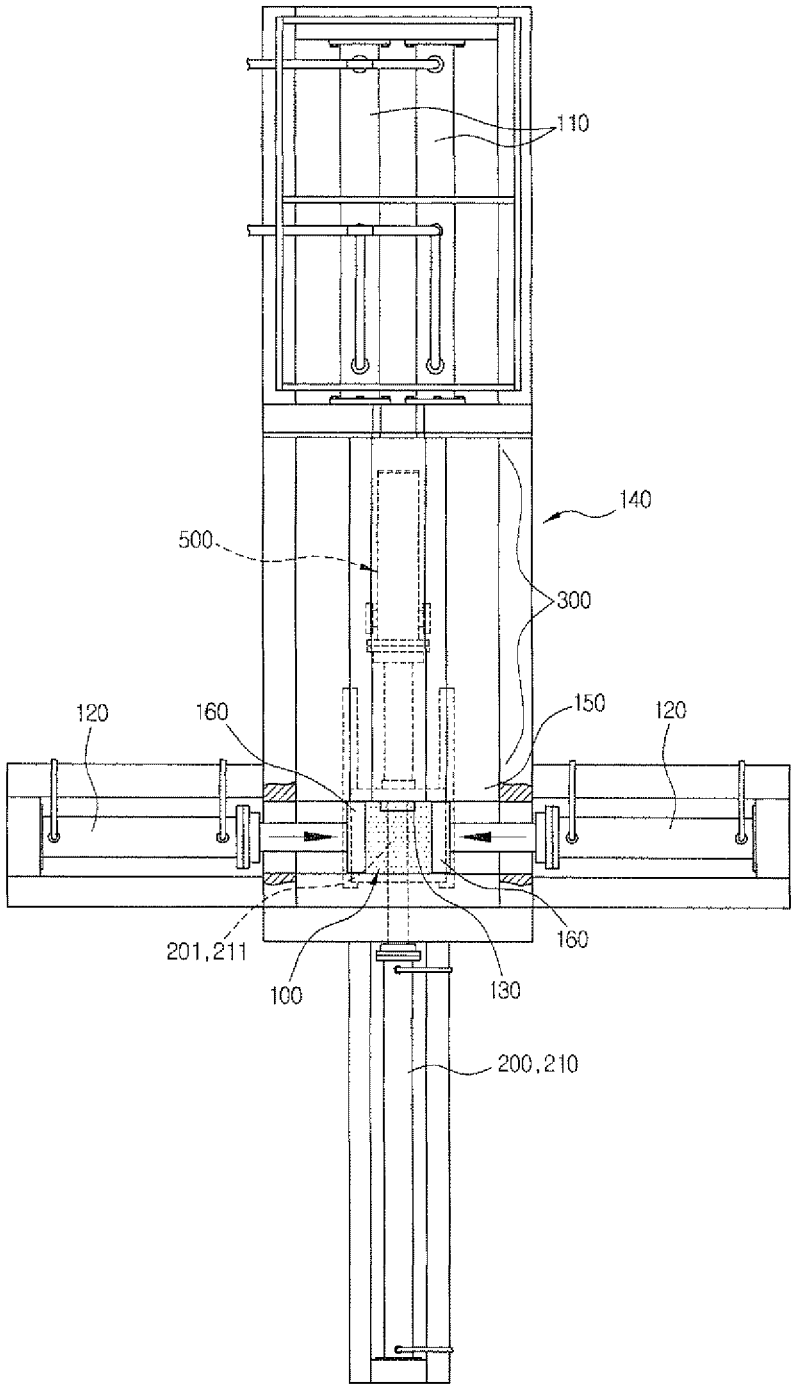
FIG. 9C is a plan view showing a state in which, after the primary press plate is advanced, a secondary press plate is advanced to a secondary compression space by a secondary compression cylinder in the apparatus for manufacturing the compressed lump of metal scrap according to the present invention.

When the secondary press plate 160 starts to compress the metal scrap in the secondary compression space 400 according to operation of the secondary compression cylinder 120 in this state, the metal scrap starts to be compressed at density higher than that of the primary compression. When the secondary press plate 160 is advanced to a position corresponding to the final dimensions of a compressed lump 100 of metal scrap, the advancement of the secondary press plate 160 is stopped by the secondary compression cylinder 120. This state is shown in FIG. 9C.

Figure 9D:
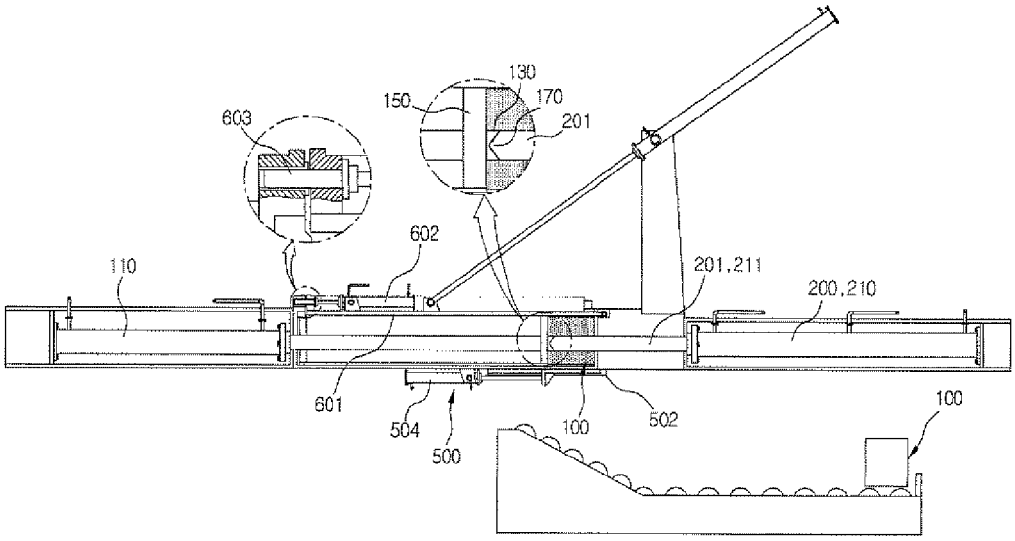
FIG. 9D is a longitudinal sectional view showing a state shown in FIG. 9C.

In this state, the through hole 101 is formed in the compressed lump 100 of metal scrap by the core 201 as shown in FIG. 9D.

Figure 9E:
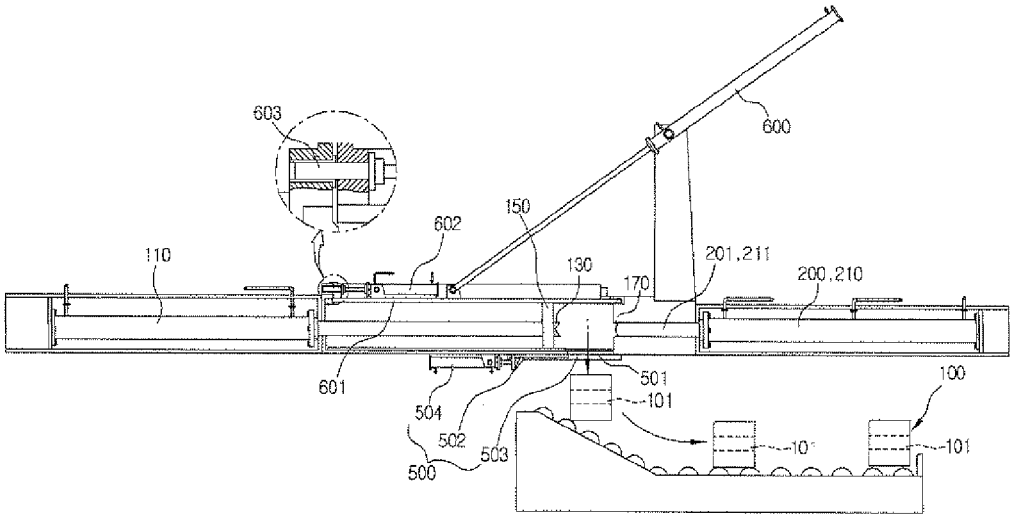
FIG. 9E is a longitudinal sectional view showing a state in which, after the primary and secondary press plates are advanced, a core and an extension core are retreated by a core cylinder and an extension core cylinder, and then a compressed lump of metal scrap is discharged through a discharge port by a discharge plate and an opening and closing cylinder to open and close the discharge plate in the apparatus for manufacturing the compressed lump of metal scrap according to the present invention.

In this state, however, the compressed lump 100 of metal scrap cannot be discharged. According to the present invention, therefore, it is necessary to retreat the core 201 and the extension core 211 disposed in the core 201 as shown in FIG. 9E.

To this end, the core cylinder 200 and the extension core cylinder 210 are driven. As a result, the core 201 and the extension core 211 are retreated, and then the primary compression cylinders 110 and the secondary compression cylinders 120 are retreated to their original positions.

In this embodiment, the core 201 is preferably formed in the shape of a pipe, in which the extension core 211 is disposed.

Also, it is necessary for the core cylinder 200 and the extension core cylinder 210 to advance and retreat the core 201 and the extension core 211 on the same axis, and therefore, the core cylinder 200 and the extension core cylinder 210 are preferably disposed on the same axis. Consequently, it is possible to manufacture the core cylinder 200 and the extension core cylinder 210 so that the core cylinder 200 and the extension core cylinder 210 can be viewed as a single cylinder.

In addition, the hydraulic cylinder of the opening and closing unit 500 is driven to move the discharge plate 502, as in the embodiment shown in FIGS. 8 and 9A to 9E, with the result that the compressed lump 100 of metal scrap falls through the discharge port 501 and is carried outside by a conveyor.

Subsequently, the locking cylinder 602 is driven to separate the piston 603 from the locking hole 604, and the cover cylinder 600 is driven to close the cover 601. In addition, the extension core 211 and the core 210 are moved by the extension core cylinder 210 and the core cylinder 200 so that the extension core 211 and the core 210 return to a state as shown in FIG. 9A. In this way, the process of manufacturing the compressed lump of metal scrap as shown in FIGS. 9A to 9E is repeatedly performed.

In brief, the method of manufacturing the compressed lump of metal scrap while forming the through hole 101 shown in FIGS. 6 and 7A to 7E according to the present invention is performed as follows.

The method of manufacturing the compressed lump of metal scrap according to the present invention includes a step of charging metal scrap into the compression chamber 140, a step of closing the cover 601 using the cover cylinder 600 and performing a locking operation, a primary compression step of primarily compressing the metal scrap charged in the compression chamber 140 using the primary compression cylinder 110, a secondary compression step of secondarily compressing the primarily compressed metal scrap using the secondary compression cylinder 120, a discharge step of discharging a compressed lump of metal scrap, compressed with target density through the secondary compression, through the discharge port, and a step of opening the cover according to an opening operation of the cover cylinder 600 so that metal scrap can be charged into the compression chamber 140, the above steps being repeatedly carried out to repeatedly compress metal scrap, wherein the method of manufacturing the compressed lump of metal scrap according to the present invention further includes a space occupation step of occupying the middle of the secondary compression space using the core 201 before the primary compression step is carried out, a through hole forming step of maintaining the region of the secondary compression space occupied by the core 210 to form the through hole 101 in the compressed lump 100 of metal scrap while performing the secondary compression using the secondary compression cylinder 120 after the primary compression is completed, and a core retreating step of retreating the core 201 to discharge the compressed lump 100 of metal scrap, compressed with target density, after the through hole 101 is formed in the compressed lump 100 of metal scrap. Also, the method of manufacturing the compressed lump of metal scrap while forming the through hole 101 shown in FIGS. 8 and 9A to 9E according to the present invention is performed as follows.

The method of manufacturing the compressed lump of metal scrap according to the present invention includes a step of charging metal scrap into the compression chamber 140, a step of closing the cover 601 using the cover cylinder 600 and performing a locking operation, a primary compression step of primarily compressing the metal scrap charged in the compression chamber 140 using the primary compression cylinder 110, a secondary compression step of secondarily compressing the primarily compressed metal scrap using the secondary compression cylinder 120, a discharge step of discharging a compressed lump of metal scrap, compressed with target density through the secondary compression, through the discharge port, and a step of opening the cover according to an opening operation of the cover cylinder 600 so that metal scrap can be charged into the compression chamber 140, the above steps being repeatedly carried out to repeatedly compress metal scrap, wherein the method of manufacturing the compressed lump of metal scrap according to the present invention further includes a space occupation step of occupying a space where the through hole 101 is to be formed in the overall compression space using the extension core 211 and the core 201 before the step of charging the metal scrap into the compression chamber 140 is carried out, an extension core retreating step of retreating the extension core 211 and the primary press plate 150 in an interlocked state while the primary compression step is carried out, an occupied space maintaining step of maintaining the middle of the compression space occupied by the core 201 while the secondary compression step is carried out, a through hole forming step of maintaining the region of the compression space occupied by the core 201 to form the through hole 101 in the compressed lump 100 of metal scrap, and a core and extension core retreating step of retreating the core 201 and the extension core 211 to discharge the compressed lump 100 of metal scrap, compressed with target density, after the through hole 101 is formed in the compressed lump 100 of metal scrap.

A method of punching or drilling the compressed lump 100 of metal scrap using a drilling machine to form the through hole 101 in the compressed lump 100 of metal scrap needs massive equipment, and high-priced materials for punching or drilling are frequently damaged or consumed. According to the present invention with the above-stated construction, on the other hand, the position of the compression chamber corresponding to the through hole 101 is previously occupied by the core 201 before the metal scrap is compressed under high pressure. Consequently, it is possible to form the through hole 101 in the compressed lump 100 of metal scrap, which is compressed with high density and thus cannot be processed except melting, while load is not applied to the core 210 and the relevant components.

Also, in the present invention, the discharge plate 502 is installed in the middle of the secondary compression space 400, and the opening and closing unit 500 using the hydraulic cylinder 504 to reciprocate the discharge plate 502 is disposed under the discharge plate 502. Of course, however, various kinds of well-known opening and closing devices may be selectively applied as needed.

Furthermore, in the present invention, well-known elements may be added or changed based on kinds of metal scrap or conditions of a manufacturing field where the apparatus for manufacturing the compressed lump. Also, the technical characteristics of the present invention are not limited to the above-described embodiments and may be variously changed within the gist and concept intended by the present invention.

As apparent from the above description, a compressed lump of metal scrap manufactured according to the present invention has one or more through holes. When the compressed lump of metal scrap is charged into a blast furnace, therefore, molten metal can infiltrate into the middle of the compressed lump of metal scrap through the through holes as well as the circumference of the compressed lump of metal scrap. Consequently, it is possible to rapidly melt the compressed lump of metal scrap at a speed equivalent to the speed at which a compressed lump of metal scrap having a size equivalent to half the size of the compressed lump of metal scrap manufactured according to the present invention, thereby greatly reducing energy necessary to manufacture steel products.

Also, in the manufacturing apparatus according to the present invention, the metal scrap is compressed around the cores during the low-density compression process of primarily compressing the metal scrap charged in the compression chamber. Consequently, it is possible to minimize friction between the cores and the metal scrap and stress applied to the cores when the through holes are formed in the metal scrap.

In addition, in the present invention, the extension core is installed at the middle of the core. When metal scrap is charged into the compression chamber in a state in which the tip of the extension core reaches the core tip receiving groove of the primary press plate, and primary compression is carried out using the primary press plate, the metal scrap is prevented from wedging into the primary press plate, the core, and the extension core, irrespective of shapes or kinds of the metal scrap. Consequently, friction between the core and the extension core and the metal scrap is prevented, and stress is prevented from being applied to the core and the extension core, thereby achieving smooth operation. In conclusion, the present invention has the effect of minimizing friction and stress applied to the core while forming the through holes in the compressed lump of metal scrap, which is compressed with high density, thereby minimizing damage to the core and thus minimizing a trouble occurrence rate.

What is claimed is:

1. A method of manufacturing a compressed lump of metal scrap, comprising:

a step of charging metal scrap into a compression chamber;

a step of closing a cover using a cover cylinder and performing a locking operation;

a primary compression step of primarily compressing the metal scrap charged in the compression chamber using a primary compression cylinder;

a secondary compression step of secondarily compressing the primarily compressed metal scrap using a secondary compression cylinder;

a discharge step of discharging a compressed lump of metal scrap, compressed with target density through the secondary compression, through a discharge port, wherein the method of manufacturing the compressed lump of metal scrap further comprises:

a space occupation step of installing a core in the middle of a secondary compression space to occupy a region of the secondary compression space where a through hole is to be formed before the primary compression step is carried out;

a through hole forming step of maintaining the region of the secondary compression space occupied by the core to form a through hole in a compressed lump of metal scrap while performing secondary compression using a secondary compression cylinder after the primary compression is completed; and a core retreating step of retreating the core to discharge the compressed lump of metal scrap, compressed with target density, after the through hole is formed in the compressed lump of metal scrap.

2. A method of manufacturing a compressed lump of metal scrap, comprising:

a step of charging metal scrap into a compression chamber;

a step of closing a cover using a cover cylinder and performing a locking operation;

a primary compression step of primarily compressing the metal scrap charged in the compression chamber using a primary compression cylinder;

a secondary compression step of secondarily compressing the primarily compressed metal scrap using a secondary compression cylinder;

a discharge step of discharging a compressed lump of metal scrap, compressed with target density through the secondary compression, through a discharge port, wherein the method of manufacturing the compressed lump of metal scrap further comprises:

a space occupation step of occupying a space where a through hole is to be formed in a primary compression space and a secondary compression space of the compression chamber using an extension core and a core before the step of charging the metal scrap into the compression chamber and the step of closing the cover is carried out;

an extension core retreating step of retreating a primary press plate and an extension core in an interlocked state while the primary compression step is carried out;

an occupied space maintaining step of maintaining the middle of the compression space occupied by the core while the secondary compression step is carried out;

a through hole forming step of maintaining the region of the compression space occupied by the core to form a through hole in a compressed lump of metal scrap; and a core and extension core retreating step of retreating the core and the extension core to discharge the compressed lump of metal scrap, compressed with target density, after the through hole is formed in the compressed lump of metal scrap.

* * * * *